United States Patent [19]

Gardner

[11] 4,062,065

[45] Dec. 13, 1977

[54] SAFETY SHOULDER STRAP HOLDER

[76] Inventor: Irving Gardner, P.O. Box 294, Hunter, N.Y. 12442

[21] Appl. No.: 781,288

[22] Filed: Mar. 25, 1977

[51] Int. Cl.[2] ..... A61J 19/00

[52] U.S. Cl. ..... 2/271; 24/86 R

[58] Field of Search ..... 2/271; 24/85 R, 86 R, 24/87 R, 73 LF, 73 GS, 86 B, 259 A, 182

[56] References Cited

U.S. PATENT DOCUMENTS

| | | | |
|---|---|---|---|
| 374,931 | 12/1887 | Brooks | 24/73 LF |
| 574,084 | 12/1896 | Deitsch | 24/73 LF |

*Primary Examiner*—Doris L. Troutman

[57] ABSTRACT

A pin-type holder to be attached to a garment on the shoulder and having a hook portion to hold the strap of a shoulder bag. The hook portion is hinged to the remainder of the holder and disconnects if the strap is pulled suddenly, thereby releasing the strap and protecting the garment material against tearing.

5 Claims, 7 Drawing Figures

SAFETY SHOULDER STRAP HOLDER

BACKGROUND OF THE INVENTION

1. Field of the Invention

This invention relates to shoulder strap holders attachable to garmet material for holding in place the strap of shoulder bags or the like and, more particularly, to a shoulder strap holder which includes releasable gripping means to allow the strap to separate readily from the holder when subjected to excessive loading.

2. Description of Prior Art

There have been on sale and in public use in the U.S. shoulder strap holders, sometimes referred to as shoulder handbag hooks, which comprise a strap receiving member of elongated substantially U-shape. Such strap receiving members typically include pin-type attachment means fixed to their underside opposite the hook portion to permit the holder to be secured to garment material. The pin of such prior art devices is aligned with the strap receiving hook portion and as a result when a load is applied thereto it is concentrated on the garment material in a small area at one end of the pin. This produces undue wear on the material.

More importantly, the hook portion of the holder supports the strap of the handbag in an unyeilding fashion so that if a sudden or unexpected pull or other high load is exerted on the strap it will inevitably be transmitted to the garment material in a manner very likely to cause tearing and may even cause injury to the user.

SUMMARY OF THE INVENTION

It is the principal object of this invention to provide a shoulder strap holder which will not cause damage to the supporting garment material or personal injury when pulled or tugged unexpectedly. Another object of the invention is to provide garment attachment means on the holder which will distribute the load of the shoulder bas as evenly and widely as possible on the garment material and thereby reduce wear. Another object is to permit the holder to be made simply and inexpensively from readily available stock material.

In its broad form, the shoulder strap holder of the present invention comprises a body member and attachment means on the body member for securing the body member to garment material. A strap receiving member of elongated susbtantially U-shape is included which comprises first and second spaced opposed arms cojoined at one end. Hinge means are provided for totatably securing the strap receiving member to the body member adjacent the cojoined ends of its arms. Releasable gripping means are included on one of the arms for normally holding the strap receiving member fixed in relation to the body member and for disconnecting under abnormal load to allow the strap supporting member to pivot on the body member about the hinge means.

In a preferred form the body member is of substantially T-shape and includes a central leg and a cross arm. The releasable attachment means is mounted on the cross arm in rotatable fashion transverse to the central leg. By this construction the normal load of the strap is distributed over a relatively large area of the garment through the attachment means rather than concentrated at one end of an attachment pin in the manner of the prior art.

Other objects and advantages of the invention will become apparent from the following description taken in conjunction with the accompanying drawing.

DESCRIPTION OF PREFERRED EMBODIMENT

Figure 1:
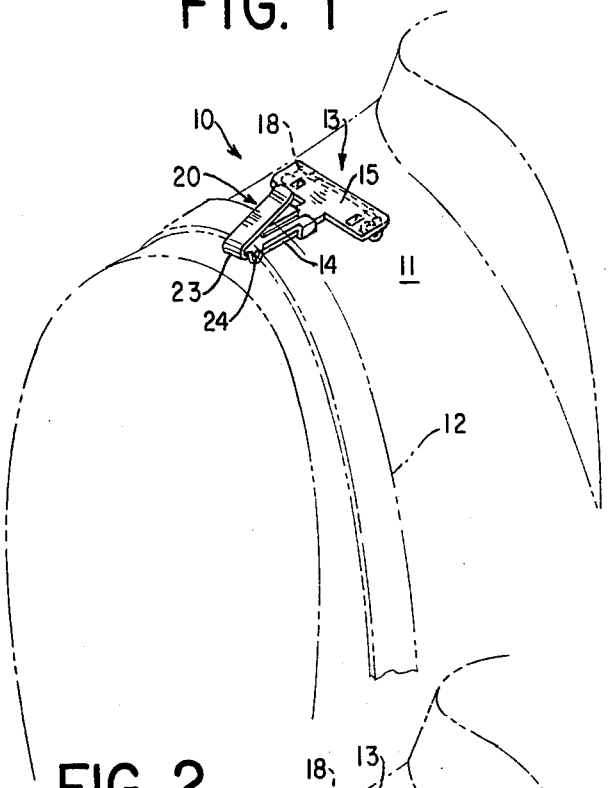
FIG. 1 is a perspective view of a preferred embodiment of the shoulder strap holder of the invention with the strap receiving member in its fixed position relative to the body member.

The shoulder strap holder 10 of the invention is intended to be secured releasably on the shoulder 11 of a garment so that when the garment is worn a strap 12 of a shoulder bag or the like can be held properly in place thereby. The holder 10 includes an integral substantially T-shaped body member 13 which in turn comprises a central leg 14 and a cross arm 15. The body member is preferably stamped from flat stock material and a pair of finger elements 16 and 16' are simultaneously punched at symmetrically spaced positions on the end portions of the cross arm 15. The finger 16 and 16' extend in the same direction from the underside of the cross arm and receive one leg 17 of a safety-type attachment pin. The other leg 17' of the pin is pointed and is designed to be inserted in the garment material in the usual manner. A safety head 18 of the pin is swaged to the leg 17 to receive the point of the leg 17'.

In the assembly of the unit the fingers 16 and 16' are first in an open position to receive the leg 17 of the pin and when the leg 17 is in place the fingers are bent loosely about it to secure the pin pivotably to the cross arm 15 of the body member 13. This pivotable mounting of the pin permits it to be easily manipulated into attached position on the garment and allows the body member to lie as flat as possible against the garment. When the body member 13 is held in place by the pin the cross arm 15 of the body member completely covers the pin from view.

At the other end of the central leg 14 of the body member 13 are a pair of trunion members 19 and 19' extending from opposite sides of that end of the leg in the same plane as the leg.

The shoulder strap holder of the invention also includes an integral strap receiving member 20 of elongated substantially U-shape. The strap receiving member is also preferably stamped from flat stock material and includes first and second flat opposed arms 21 and 22 respectively. The arms 21 and 22 are cojoined by a curved intermediate section 23. A pair of hinge members 24 and 24' extend in the same direction perpendicularly from the respective opposite sides of the arm 21 immediately adjacent the intermediate section 23. These hinge members are formed with respective coaxial holes rotatably receiving the pair of trunions 19 and 19'.

The arm 21 of the strap receiving member 20 is also formed with a longitudinal slot 25 in its end portion opposite the hinge members 24 and 24'.

A pair of gripping tabs 26 and 26' extend in the same direction as the hinge members 24 and 24' substantially perpendicularly from respective opposite sides of the outer end of the slotted portion of the arm 21. These gripping tabs are resiliently movable toward any away from one another.

Figure 3:
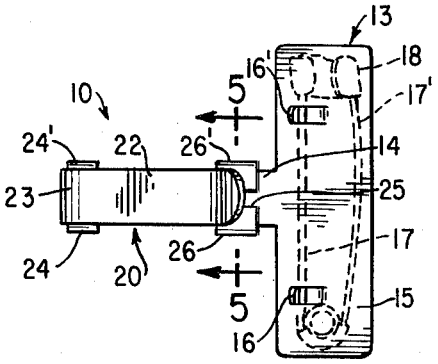
FIG. 3 is a top plan view of the shoulder strap holder showing the strap receiving member in its fixed position.
Figure 5:
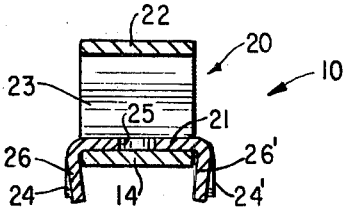
FIG. 5 is a enlarged section taken along the line 5—5 of FIG. 3.

In operation the shoulder strap holder 10 is pinned to the shoulder garment by the releasable pin and when the leg 17' thereof is firmly within the safety head 18 the holder 10 rests flat against the garment. The body member 13 is normally in the position shown in FIGS. 1, 3 and 5 of the drawings with the strap receiving member fixed in relation to the body member. This is accomplished by snapping the tabs 26 and 26' of the arm 21 about the central leg 14 of the body member. The strap 12 is readily held in place under the outer arm 22 of the strap receiving member 20 and the weight thereof further causes the holder to lie flat against the garment with the load evenly and widely distributed through the releasable pin to the garment material in a manner least likely to cause damage.

Figure 4:
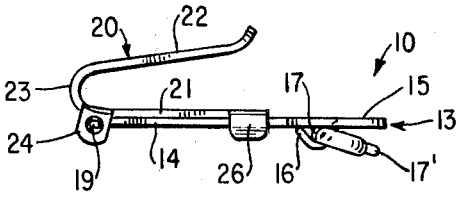
FIG. 4 is a side elevation of the shoulder strap holder.
Figure 2:
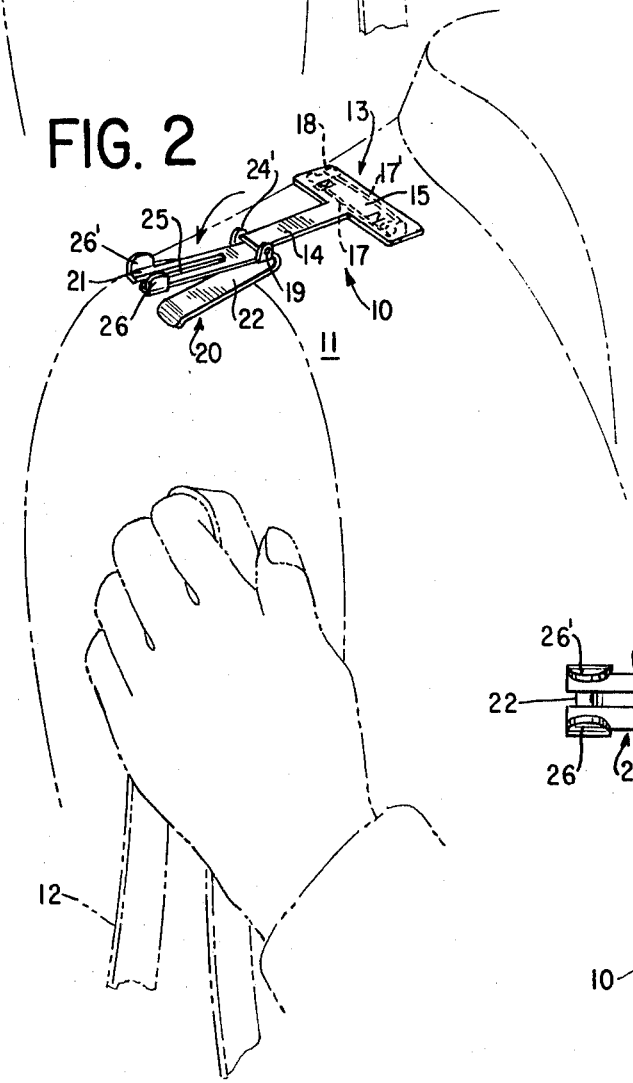
FIG. 2 is a perspective view showing the strap receiving member pivoted to its disconnected position relative to the body member.
Figure 6:
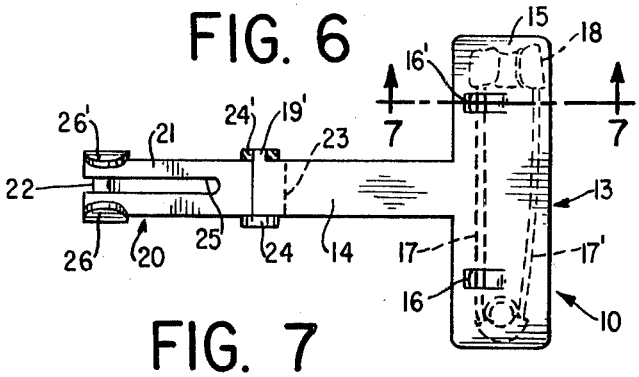
FIG. 6 is a top plan view showing the strap receivng member in its disconnected position.
Figure 7:
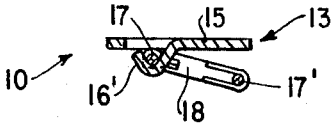
FIG. 7 is a section taken along the line 7—7 of FIG. 6.

The major feature of the invention is that the strap receiving member will disconnect if a sudden pull or impact or other abnormal load is appied to the strap. In the devices of the prior art such a loading would simply be transmitted through the holder to the garment and could very well cause tearing or other damage. In the holder of the invention, however, such loading will cause the resilient tabs 26 and 26' to disconnect from the central leg 14 of the body member to allow the body member to pivot at the hinge members 24 and 24' about the trunions 19 and 19'. As a result the strap receiving member will rotate from the position shown in FIGS. 1, 3 and 4 to the disconnected position shown in FIGS. 2 and 6. In this latter position the strap 12 is released and the garment material is thereby relieved of the load which could otherwise cause damage to it.

The scope of the present invention is set forth in the following claims rather than in the foregoing desription of a preferred embodiment thereof.

I claim:

1. A shoulder strap holder comprising:

a. a body member;

b. attachment means on said body member for securing said body member to garment material; and c. a strap receiving member of elongated substantially U-shape comprising:

i. first and second spaced opposed arms cojourned at one end, ii. hinge means securing the strap receiving member adjacent the cojoined ends of its arms to the body member, and iii. releasable gripping means on one of said arms for normally holding the strap receiving member fixed in relation to said body member and for disconnecting under high load to allow the strap supporting member to pivot on said body member about said hinge means.

2. A shoulder strap holder comprising:

a. a substantially T-shaped body member comprising:

i. a central leg, and ii. a cross arm, b. releasable attachment means mounted on said cross arm for securing the body member to garment material; and c. a strap receiving member of elongated substantially U-shape comprising:

i. first and second spaced opposed arms and an intermediate section cojoining said arms;

ii. hinge members extending from the respective opposite sides of one arm immediately adjacent said intermediate section and being rotatably connected to said central leg; and iii. resilient releasable gripping tabs extending from respective opposite sides of the outer end of said arm having the hinge means;

d. whereby said gripping tabs normally hold the strap receiving member fixed in relation to said body member and are disconnectable under high load to allow the strap supporting member to pivot on said body member about said hinge members.

3. A shoulder strap holder according to claim 2 wherein said arm from which said hinge members extend is formed with a longitudinal slot in its end portion opposite said hinge members.

4. A shoulder strap holder comprising:

a. a substantially T-shaped body member comprising:

i. a central leg, ii. a cross arm, iii. a pair of flanges extending in the same direction perpendicularly from the respective opposite ends of the cross arm, and iv. a pair of trunion members extending from opposite sides of that end of the leg opposite the cross arm in the same plane as the leg;

b. releasable pin attachment means pivotably mounted on and aligned with said cross arm for securing the body member to garment material; and c. an integral strap receiving member of elongated substantially U-shape comprising:

i. first and second flat spaced opposed arms and a curved intermediate section cojoining said arms;

ii. a pair of hinge members extending in the same direction perpendicularly from the respecitve opposite sides of one arm immediately adjacent said intermediate section and having respective coaxial holes rotatably receiving the pair of trunions; and iii. a pair of gripping tabs extending in the same direction as the hinge members perpendicularly from respective opposite sides of the outer end of slotted arm and being resiliently movable with respect to one another;

d. whereby said gripping tabs normally hold the strap receiving member fixed in relation to said body member and are disconnectable under high load to allow the strap supporting member to pivot on said body member about said hinge members.

5. A shoulder strap holder according to claim 4 wherein each of said body member and strap receiving member are of integral one-piece construction, and said arm from which said hinge members extend is formed with a longitudinal slot in its end portion opposite said hinge members.

* * * * *